US008620015B2

(12) United States Patent
Andersson et al.

(10) Patent No.: US 8,620,015 B2
(45) Date of Patent: Dec. 31, 2013

(54) VIBRATOR FOR BONE CONDUCTING HEARING DEVICES

(75) Inventors: Marcus Andersson, Göteborg (SE); Erik Holgersson, Gothenburg (SE); Lars Jinton, Molndal (SE); Patrick Strömsten, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 103 days.

(21) Appl. No.: 12/601,797

(22) PCT Filed: May 20, 2008

(86) PCT No.: PCT/SE2008/000336
§ 371 (c)(1),
(2), (4) Date: Nov. 24, 2009

(87) PCT Pub. No.: WO2008/143573
PCT Pub. Date: Nov. 27, 2008

(65) Prior Publication Data

US 2010/0179375 A1 Jul. 15, 2010

(30) Foreign Application Priority Data

May 24, 2007 (SE) ..... 0701242

(51) Int. Cl.
*H04R 25/00* (2006.01)

(52) U.S. Cl.
USPC ..... 381/380; 381/151; 600/25

(58) Field of Classification Search
USPC ..... 381/151, 364, 380; 600/25, 55–57; 181/128–137
See application file for complete search history.

(56) References Cited

U.S. PATENT DOCUMENTS 2,045,403 A 6/1936 Nicholides
2,045,404 A 6/1936 Nicholides (Continued)

FOREIGN PATENT DOCUMENTS

DE 19643180 4/1997
JP 59-178986 10/1984

(Continued)

OTHER PUBLICATIONS

International Search Report. PCT/SE2008/000336. Mailed Sep. 3, 2008.

(Continued)

*Primary Examiner* — Davetta W Goins
*Assistant Examiner* — Amir Etesam
(74) *Attorney, Agent, or Firm* — Kilpatrick, Townsend & Stockton, LLP.

(57) ABSTRACT

A vibrator for generating vibrations in a bone conducting hearing device, i.e. a hearing device of the type in which the sound information is mechanically transmitted via the skull bone directly to the inner ear of a person. The vibratory movements are provided by a piezo-electric or magneto-elastic element arranged to transfer the vibrations via the skull bone from the area behind the outer ear to the inner ear. The piezo-electric or magneto-elastic element is arranged to be at least partially implanted in a surgically drilled hole directly into the mastoid bone behind the outer ear so that the vibrations are transferred directly from the element to the bone and transferred in the skull bone to the inner ear. The element is encapsulated with a bone integrating material, such as titanium or various biocompatible ceramic materials or coatings and is disc shaped and acts with a radial expansion upon electrical stimulation so that longitudinal sound waves are induced into the skull bone.

21 Claims, 2 Drawing Sheets

(56) References Cited

U.S. PATENT DOCUMENTS

| | | | | |
|---|---|---|---|---|
| 2,045,427 | A | 6/1936 | White | |
| 2,239,550 | A | 4/1941 | Cubert | |
| 3,594,514 | A | 7/1971 | Wingrove | |
| 4,498,461 | A | 2/1985 | Hakansson | |
| 4,612,915 | A | 9/1986 | Hough et al. | |
| 4,904,233 | A | 2/1990 | Hakansson et al. | |
| 4,937,489 | A | 6/1990 | Hattori et al. | |
| 4,952,835 | A | 8/1990 | Stahlhuth | |
| 4,964,106 | A | 10/1990 | Bromfield | |
| 5,228,092 | A | 7/1993 | Nakamura et al. | |
| 5,245,245 | A | 9/1993 | Goldenberg | |
| 5,286,199 | A | 2/1994 | Kipke | |
| 5,444,324 | A | 8/1995 | Priest et al. | |
| 5,589,725 | A | 12/1996 | Haertling | |
| 5,772,575 | A * | 6/1998 | Lesinski et al. | 600/25 |
| 5,788,711 | A | 8/1998 | Lehner et al. | |
| 6,273,681 | B1 | 8/2001 | Yamakawa et al. | |
| 6,294,859 | B1 | 9/2001 | Jaenker | |
| 6,371,415 | B1 | 4/2002 | Lorkowski et al. | |
| 6,411,009 | B2 | 6/2002 | Jaenker | |
| 6,463,157 | B1 | 10/2002 | May | |
| 6,554,761 | B1 | 4/2003 | Puria et al. | |
| 6,629,922 | B1 * | 10/2003 | Puria et al. | 600/25 |
| 6,631,197 | B1 | 10/2003 | Taenzer | |
| 6,751,334 | B2 | 6/2004 | Hakansson | |
| 6,927,528 | B2 | 8/2005 | Barillot et al. | |
| 6,994,110 | B2 | 2/2006 | Barillot et al. | |
| 7,026,746 | B2 | 4/2006 | Andren et al. | |
| 7,045,932 | B2 | 5/2006 | Xu et al. | |
| 7,224,815 | B2 * | 5/2007 | Maltan et al. | 381/322 |
| 7,378,783 | B2 | 5/2008 | Pelrine et al. | |
| 7,564,988 | B2 | 7/2009 | Azima et al. | |
| 7,722,524 | B2 * | 5/2010 | Lupin et al. | 600/25 |
| 2002/0039427 | A1 | 4/2002 | Whitwell et al. | |
| 2003/0137218 | A1 | 7/2003 | Hermle et al. | |
| 2005/0020873 | A1 | 1/2005 | Berrang et al. | |
| 2006/0023908 | A1 | 2/2006 | Perkins et al. | |
| 2006/0025648 | A1 | 2/2006 | Lupin et al. | |
| 2007/0041595 | A1 | 2/2007 | Carazo et al. | |
| 2007/0156011 | A1 | 7/2007 | Westerkull | |
| 2007/0191673 | A1 | 8/2007 | Ball et al. | |
| 2009/0052698 | A1 | 2/2009 | Rader et al. | |
| 2009/0115292 | A1 | 5/2009 | Ueda et al. | |
| 2009/0245553 | A1 | 10/2009 | Parker | |
| 2009/0245555 | A1 | 10/2009 | Parker et al. | |
| 2009/0247810 | A1 | 10/2009 | Parker et al. | |
| 2009/0247811 | A1 | 10/2009 | Parker | |
| 2009/0248085 | A1 | 10/2009 | Parker | |
| 2009/0248086 | A1 | 10/2009 | Parker | |
| 2010/0298626 | A1 | 11/2010 | Andersson et al. | |

FOREIGN PATENT DOCUMENTS

| | | | |
|---|---|---|---|
| JP | 64-073781 | | 3/1989 |
| JP | 01-290272 | | 11/1989 |
| WO | 01/93633 | A1 | 12/2001 |
| WO | 01/93634 | A1 | 12/2001 |
| WO | 01/93635 | A1 | 12/2001 |
| WO | 03001846 | | 1/2003 |
| WO | 03/096744 | A1 | 11/2003 |
| WO | 2004032566 | A1 | 4/2004 |
| WO | 2007024657 | A2 | 3/2007 |
| WO | 2007052251 | A2 | 5/2007 |
| WO | 2007078506 | A2 | 7/2007 |
| WO | 2008/143573 | | 11/2008 |
| WO | 2009/121104 | | 10/2009 |
| WO | 2009/0121116 | | 11/2009 |

OTHER PUBLICATIONS

Janocha, "Actuators: Basics and Applications", Springer Verlag 2004, Jul. 8, 2009, pp. 265-267. Available at: <http://books.google.com.au/books?id.

Juuti, et al., "Mechanically Amplified large displacement piezoelectric actuators", Sensors and Actuators A 120, Dec. 22, 2004, pp. 225-231.

International Application No. PCT/AU2009/000358, International Preliminary Report on Patentability mailed on Oct. 5, 2010, 7 Pages.

International Application No. PCT/AU2009/000358, International Search Report mailed on Jul. 14, 2009, 4 Pages.

International Application No. PCT/AU2009/000358, Written Opinion mailed on Jul. 14, 2009, 6 Pages.

International Application No. PCT/AU2009/000372, International Preliminary Report on Patentability mailed on Oct. 5, 2010, 8 Pages.

International Application No. PCT/AU2009/000372, International Search Report mailed on Jun. 29, 2009, 3 Pages.

International Application No. PCT/AU2009/000372, Written Opinion mailed on Jun. 29, 2009, 7 Pages.

Zhou, et al., "Analysis of a diamond-shaped mechanical amplifier for a piezo actuator", Int J Adv Manuf Technol, vol. 32, 2007, pp. 1-7.

Danish Office Action for application No. PA 2009 01240, mailed Feb. 6, 2013 (3 pages).

* cited by examiner

VIBRATOR FOR BONE CONDUCTING HEARING DEVICES

CROSS-REFERENCE TO RELATED APPLICATIONS

This application is a national stage application under 35 USC §371 (c) of PCT Application No. PCT/SE2008/000336, entitled "VIBRATOR FOR BONE CONDUCTING HEARING DEVICES," filed on May 20, 2008, which claims priority from Swedish Patent Application No. 0701242-0, filed on May 24, 2007. This application is related to commonly owned and co-pending U.S. Utility Patent Application entitled "IMPLANT ABUTMENT," filed Nov. 24, 2009, which is a national stage application of PCT Application No. PCT/SE2008/000337, filed May 21, 2008. This application is also related to commonly owned and co-pending U.S. Utility Patent Application entitled "ANCHORING ELEMENT" which is a national stage application under 35 USC §371 (c) of PCT Application No. PCT/SE2008/000338, filed on May 21, 2008. The entire disclosure and contents of the above applications are hereby incorporated by reference herein.

BACKGROUND

1. Field of the Invention

The present invention relates to a vibrator for generating vibrations in a bone conducting hearing device, i.e. a hearing device of the type in which the sound information is mechanically transmitted via the skull bone directly to the inner ear of a person.

2. Related Art

For persons with impaired hearing, the hearing aid devices which are most commonly used today are those based on the principle that the sound is amplified and fed into the auditory meatus and stimulates the eardrum from the outside. In order to prevent acoustic feedback problems in these devices, the auditory meatus is almost completely plugged by a hearing plug or by the hearing aid device itself. This causes the user a feeling of pressure, discomfort, and sometimes even eczema. In some cases it even causes the user problems like running ears due to chronic ear inflammations or infections in the auditory canal.

However, there are other types of hearing aid devices on the market, i.e. hearing devices based on another type of sound transmitting principle, specifically bone conducting hearing devices which mechanically transmit the sound in-formation to a persons inner ear via the skull bone by means of a vibrator. The hearing aid device is connected to an implanted titanium screw installed in the bone behind the external ear and the sound is transmitted via the skull bone to the cochlea (inner ear), i.e. the hearing device works irrespective of a disease in the middle ear or not. The bone anchoring principle means that the skin is penetrated which makes the vibratory transmission very efficient.

This type of hearing aid device has been a revolution for the rehabilitation of patients with certain types of impaired hearing. It is very convenient for the patient and almost invisible with normal hair styles. It can easily be connected to the implanted titanium fixture by means of a snap in coupling. One example of this type of hearing aid device is described in U.S. Pat. No. 4,498,461 and it is also referred to as the Baha® marketed by Cochlear Bone Anchored Solutions AB (previously named Entific Medical Systems AB) in Gôteborg, Sweden.

Other types of bone conducting hearing aids are described in U.S. Pat. No. 4,904,233 and WO 01/93635.

A common feature for the hearing aid devices which have been described so far is that some type of vibratory generating means, vibrators, are required. Different types of vibrators are well known in the art. There are a number of known vibrator principles today. In traditional as well as in bone anchored hearing aid devices it is normally used a vibrator principle which was described already by Bell in 1876. There is a detailed description of this principle applied on a bone anchored, bone conducting hearing aid device in "On Direct Bone Conduction Hearing Devices", Technical Report No. 195, Department of Applied Electronics, Chalmers University of Technology, 1990. Other vibrators of this type are described in WO 01/93633, WO 01/93634, U.S. Pat. No. 6,751,334 and PCT/SE03/00751.

A typical vibrator of this type comprises a magnetic device, a vibrator plate and a so-called inner spring member in order to provide an air-gap between the magnetic device and the vibrator plate. The entire vibrator arrangement is housed in a casing and the vibrator plate is mechanically connected via a vibratory transmitting element to a coupling device, such as a snap-in coupling, a magnetic coupling or the like, for connecting the outer hearing aid part to the bone anchored part of the hearing aid device.

To prevent dust and dirt to come into the hearing aid housing there is a sealing between the casing of the hearing aid and the vibratory transmitting element, for instance a plastic membrane.

A disadvantage with this type of vibrator arrangement is the fact that it comprises so many small parts which makes it difficult to assemble. The separate suspension of the outer spring and the sealing of the casing comprises small elastic elements which must be robust enough to withstand a long-time use of the hearing aid but also weak and soft enough to serve as a vibratory isolating and dust sealing element.

Another disadvantage with the known arrangement is the fact that the vibratory isolation is not always optimal due to the fact that the outer spring, that is in the form of a small, thin metal plate which is weak in one direction, perpendicular to the plane of the spring plate, but stiff against movements in other directions parallel to the plane of the spring plate and also stiff against rotary movements. Vibratory movements in these directions are absorbed by silicon pads only.

It should be noted that a piezo-electric element also work the other way around; when it is subjected to compression etc. it releases an electrical pulse.

Piezo-electric elements have previously been used in cochlear hearing aids. A piezo-electric element is basically a material that changes its shape when an electric current is placed over it. Thus, vibrations of the piezo-element can be achieved electrically. A piezo-electric element can be designed to shape-change in specific directions so that transversal or longitudinal vibrations can be attained. In U.S. Pat. No. 3,594,514 it is described an implantable hearing aid apparatus having a piezo-electric ceramic element mounted adjacent to the auditory conductive system of the inner ear for imparting vibration there-to. Specifically, the piezo-electric element is mounted so that the vibration will be mechanically transmitted directly to the auditory ossicle or oval window or other member of the auditory system of the inner ear.

In US 2005/0020873 it is described an implantable hearing prosthesis having an inertial vibrational element implanted in bone between the lateral and superior semicircular canals without breaching the integrity of the canals. It is stated that the vibrational element is adapted to vibrate the walls of the canals and the fluids contained therein, thereby vibrating contiguous fluids within the cochlea thus stimulating hair cells and creating a hearing concept.

SUMMARY

In one aspect of the present invention, a vibrator for generating vibrations in a bone conducting hearing device is provided. The vibrator comprises: a hearing device configured to mechanically transmit the sound information via the skull bone directly to the inner ear of a person, comprising: a piezo-electric or magneto-elastic element arranged to transfer the vibrations via the skull bone from the area behind the outer ear to the inner ear.

BRIEF DESCRIPTION OF THE DRAWINGS

Illustrative embodiments of the present invention will be described herein with reference to the accompanying figures, in which.

DETAILED DESCRIPTION

Figure 1:
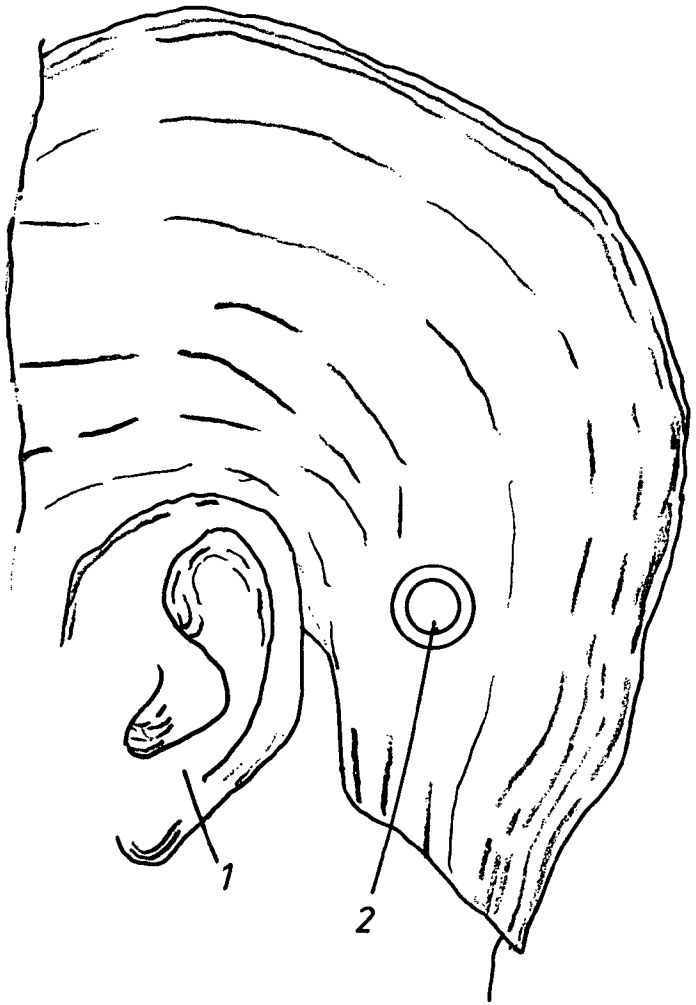
FIG. 1 illustrates the general location of the piezo-electric element on the skull of a person.
Figure 1:
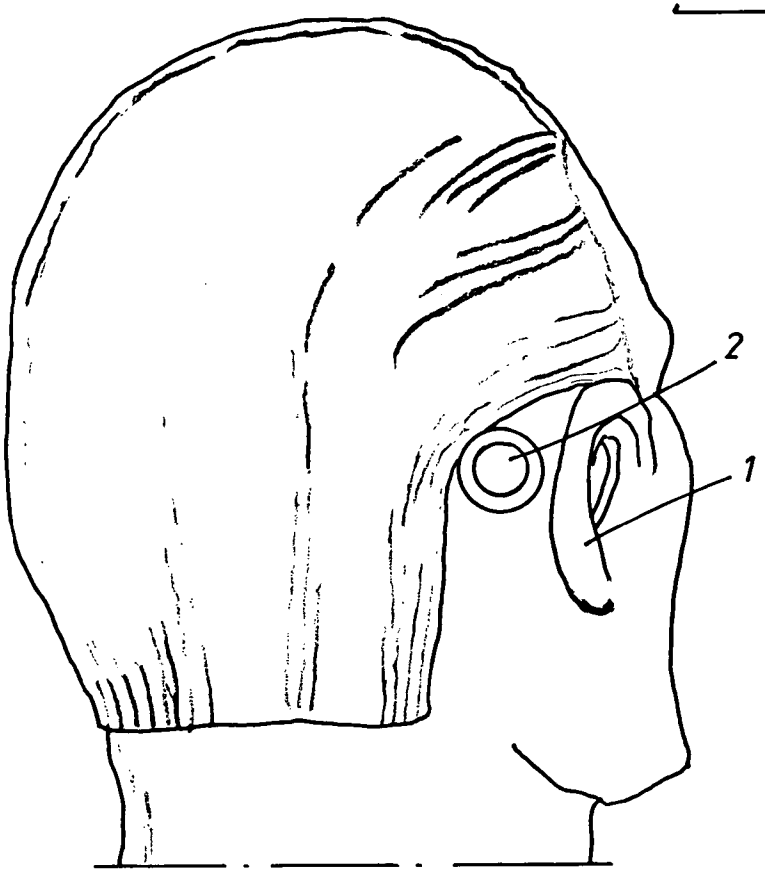

FIG. 1 shows schematically the general location of the bone conducting hearing aid device according to the invention. The hearing aid device is anchored in the skull bone, preferably in the mastoid bone, behind the external ear 1 of a person. The hearing aid device may comprise of two separate parts, an externally located part, schematically indicated by reference numeral 2 in the figure, and an implanted part. However, also the entire hearing aid device might be implanted in the mastoid bone behind the external ear 1. The sound is received by the external part 2 via a microphone and is then amplified and filtered in an external electronic circuitry which is power supplied by a battery. The amplified signal is transmitted by induction (transcutaneously) or by any other known means, such as a cord connection, through the skin to the implanted part (percutaneously). These parts are well known in the art and will not be described in any detail here.

To use inductive transmission through the skin of an auditory signal is previously known especially by other types of hearing aid devices. In our case the vibrator in the form of a piezo-electric element is at least partially implanted in the bone under the skin. The induction transmitted signal is received to the piezo-electric element and the electrical signal is converted into vibrations.

Figure 2:
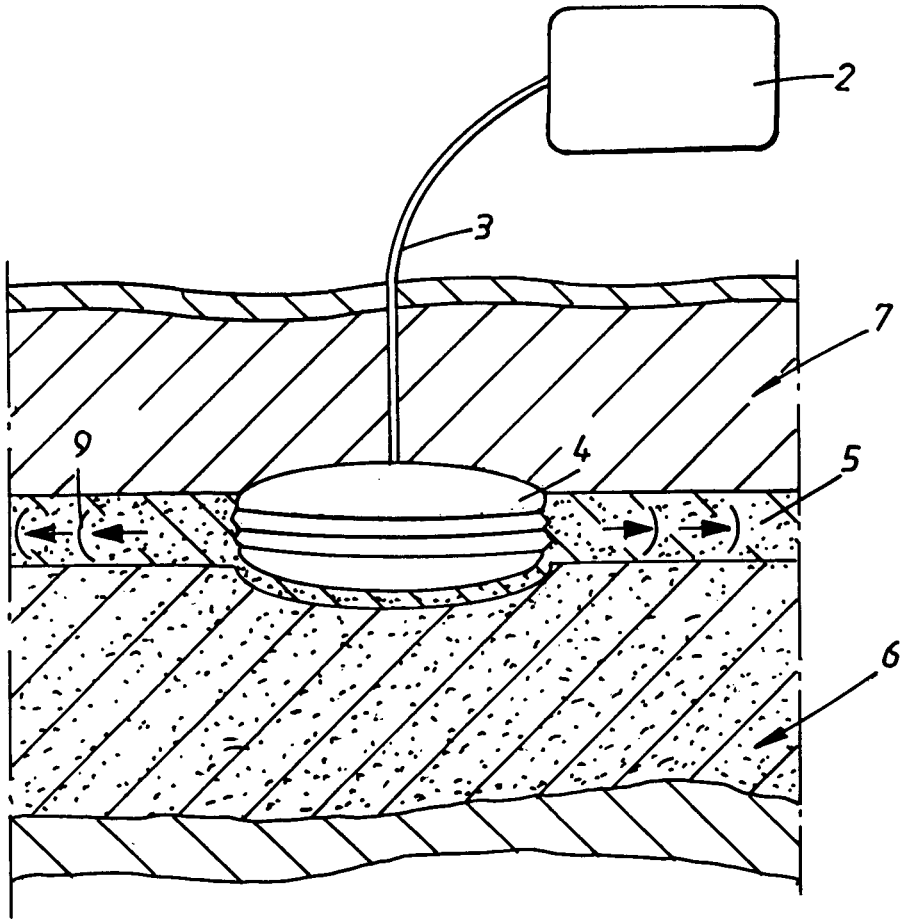
FIG. 2 illustrates a piezo-electric element partially implanted into the skull bone of a person.
Figure 3:
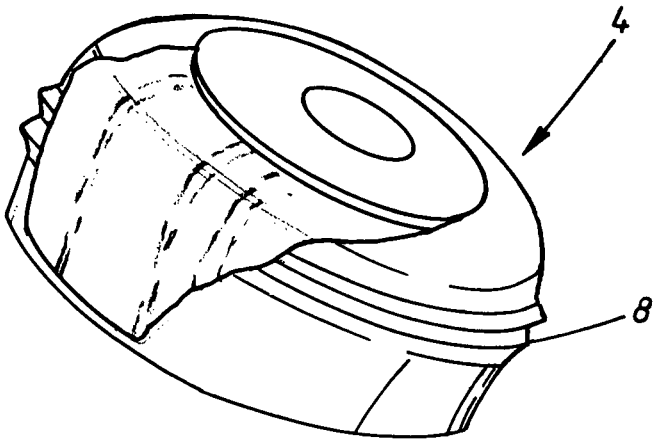
FIG. 3 illustrates the general, outer design of the piezo-electric element.

As an alternative there is a cord connection 3 between the externally mounted electrical components 2 and the implanted piezo-electric element 4, see FIG. 2. A passage is formed through the skin by means of any suitable skin penetrating sleeve connector or the like.

As illustrated in FIG. 2 the encapsulated disc shaped piezo-electric element 4 is implanted in a surgically drilled cavity in the hard, cortical bone layer 5 of the scull bone 6. There is no need for a complete hole or passage through the skull bone. Preferably the piezo-electric element is arranged in the cortical bone layer only, with its upper slightly rounded surface contacting the surrounding skin 7. This is one of the reasons for the disc shaped design of the element.

In order to improve the initial mechanical stability of the implanted element 4 the casing is provided with circumferential rills or threads 8. Possibly such threads are provided with self-cutting edges. As alternatives to be threaded, the implant might be press-fitted, glued or secured into the surgically drilled hole by means of fixtures or pins.

In order to improve the long-term stability of the implanted element 4 the outer surface of the element is made of a biocompatible and bone integrating material, such as titanium, titanium alloys, tantalum, zirconium, niobium, hafnium, vitallium or polymeric materials or gels or a various ceramic material or coating, such as hydroxyl apatite, silica based or carbon based ceramics. Preferably the surface has been modified using techniques that include grit-blasting, polishing, micro-machining, laser treatment, turning, anodization, oxidation, chemical etching, sintering or plasma deposition. Such treatment of the surface might provide a specific roughness to the surface in order to optimize the bone integrating process.

In addition to such surface modifications pharmaceutical drugs, bio-molecules or other chemical molecules with bone tissue stimulating properties may be used.

The other reason for designing in certain embodiments of the piezo-electric element with a typical disc-shaped design is the fact that the element then acts with radial expansion upon electrical stimulation. This induces longitudinal sound waves, illustrated by reference numeral 9 in the figure, to the skull, i.e. sound waves that will be directed along the comparatively thin skull bone (instead of any other direction), which is energetically favorable.

It should also be understood that the embodiments with the piezo-electric element implanted directly into the bone have the advantage of eliminating the need for a counterweight which otherwise is needed for an external mounting.

As already mentioned, in certain embodiments the piezo-electric element works both ways as also the vibrations can be transformed to electric pulses. This introduces an option, but not a necessity, for the piezo-electric element to work as a microphone allowing a two-way communication which can be utilized for hooking up to telephone or other radio communication equipments.

Some embodiments of the piezo-electric element comprise a radial expanding piezo-electric material, such as lead zirconate titanate or the like, with electrodes placed on each side of the piezo-electric element. In certain embodiments the piezo-electric element is placed in a titanium casing with the electrical cords sticking out from it.

A method for installing the piezo-electric element includes a surgical step by drilling a cavity into the skull bone with a depth of about 2-3 mm and a width of about 10 mm. The piezo-electric element is placed in this perfectly fitted cavity in the skull by any of the previously mentioned methods, and is left to integrate with the bone for about six weeks which should be sufficient time for biological osseointegration. The electrical cords are then mounted to a connector that is penetrating the skin, a percutaneous solution, or to a transcutaneous arrangement. After due time, the electronics (including the battery) is mounted on the connector and individual adjustments to the audio can be performed to optimize the sound quality.

According to a certain embodiments of the present invention, the piezo-electric element is implanted in a surgically drilled cavity in the bone. There is no need for a complete hole through the skull. According to a further embodiment the piezoelectric element is encapsulated with a bone integrating material, such as titanium or various biocompatible ceramic materials or coatings. The electrical components could either be implanted as well, or they could be mounted externally. According to another embodiment the piezo-electric element is disc shaped and acts with a radial expansion upon electrical stimulation. This induces longitudinal sound waves to the skull which is energetically favorable.

The invention is not limited to the examples illustrated so far but can be varied within the scope of the accompanying claims. Specifically, it should be understood that as an alternative to the piezo-electric elements there is also a group of materials called magneto-elastic materials. This group of materials works similar to the piezo-electric elements but instead they change their shape due to a magnetic field. This could be an equally good alternative to the piezo-electric element. However, for simplicity reasons only piezo-electric elements has been mentioned in the examples above.

The piezo-electric or magneto-elastic element has been illustrated here in a bone conducting hearing device of the type in which the sound information is mechanically transmitted via the skull bone directly to the inner ear of a person. This type of hearing aid device is used for the rehabilitation of patients with certain types of impaired hearing, but it can also be used for the rehabilitation of persons with stuttering problems. It should be understood that the present invention also relates to such anti-stuttering applications.

Advantageously, certain embodiments of the invention include a piezoelectric element configured to provide vibratory movements directly into the skull bone behind the outer ear. The vibrations are transferred via the skull bone from the area behind the outer ear to the inner ear. Specifically, instead of conducting the sound via the skin penetrating abutment and the fixture, according to our invention the piezo-electric element is at least partially implanted directly into the skull bone behind the outer ear so that the vibrations are transferred directly from the vibratory element to the bone and transferred in the skull bone to the inner ear.

Further features and advantages of the present invention may be found in commonly owned and co-pending U.S. Utility Patent Application entitled "IMPLANT ABUTMENT," filed Nov. 24, 2009, which is a national stage application of PCT Application No. PCT/SE2008/000337, filed May 21, 2008; and in commonly owned and co-pending U.S. Utility Patent Application entitled "ANCHORING ELEMENT" which is a national stage application under 35 USC §371 (c) of PCT Application No. PCT/SE2008/000338, filed on May 21, 2008. The entire disclosure and contents of these applications are hereby incorporated by reference herein.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A vibrator for generating vibrations in a bone conducting hearing device, comprising:

a hearing device configured to mechanically transmit sound information via a skull bone directly to an inner ear of a person, comprising: a piezo-electric or magneto-elastic element including a generally cylindrical and radially expandable bone contacting surface configured to transfer the vibrations via the skull bone from an area behind an outer ear to the inner ear; wherein the piezo-electric or magneto-elastic element is arranged to be at least partially implanted directly into the skull bone behind the outer ear so that the vibrations are transferred directly from the element to the bone and transferred in the skull bone to the inner ear.

2. The vibrator according to claim 1 wherein the piezo-electric or magneto-elastic element is arranged to be implanted in a surgically drilled cavity in the skull bone.

3. The vibrator according to claim 2 wherein the piezo-electric or magneto elastic element is encapsulated with a bone integrating material.

4. The vibrator according to claim 1 wherein the piezo-electric or magneto elastic element is disc shaped and acts with a radial expansion upon electrical and magnetic field stimulation, respectively, that induces longitudinal sound waves into the skull bone.

5. The vibrator according to claim 3 further comprising a casing that encapsulates the piezo-electric or magneto elastic element, wherein the casing is provided with circumferential rills or threads.

6. The vibrator according to claim 1 wherein the piezo-electric or magneto elastic element is arranged to work as a microphone allowing a two-way communication which can be utilized for hooking up to telephone or other radio communication equipments.

7. The vibrator according to claim 1 wherein the piezo-electric or magneto-elastic element comprises a piece of radial expanding piezo-electric material with electrodes placed on each side of the piezo-electric element, the entire piece being placed in a titanium casing.

8. The vibrator according to claim 1:

wherein the piezo-electric or magneto elastic element is arranged in a bone conducting hearing device.

9. A hearing prosthesis, comprising:

an implantable component including at least one of a piezo-electric or magneto-elastic element including a generally cylindrical and radially expandable bone contacting surface configured to generate vibrations in response to a sound signal, wherein the implantable component is configured to be implanted in a recipient at a location outside a middle ear of the recipient, and the hearing prosthesis is configured such that the generated vibrations pass through bone of the recipient on a route from the implantable component to an inner ear of the recipient; wherein the piezo-electric or magneto-elastic element is arranged to be at least partially implanted directly into the skull bone behind the outer ear so that the vibrations are transferred directly from the element to the bone and transferred in the skull bone to the inner ear.

10. The hearing prosthesis according to claim 9, wherein: the bone is a skull bone of the recipient; and the implantable component is configured to be at least partially implanted into the skull such that the generated vibrations are transferred from the implantable component to the skull.

11. The hearing prosthesis according to claim 9, wherein: the bone is a skull bone of the recipient; and the implantable component is configured to be at least partially implanted directly into the skull such that the generated vibrations are transferred from the implantable component directly to the skull.

12. The hearing prosthesis according to claim 9, wherein:

the implantable component is configured to be at least partially implanted in a cortical bone layer of a skull of a recipient such that the generated vibrations are transferred from the implantable component directly to the cortical bone layer.

13. The hearing prosthesis according to claim 9, wherein:

the implantable component is configured to be implanted in a surgically drilled cavity in the skull bone that extends only partially into the skull bone.

14. The hearing prosthesis according to claim 9, wherein:

the implantable component is configured to generate the vibrations by altering a diameter thereof upon at least one of electrical or magnetic field stimulation of the respective piezo-electric or magneto elastic element, wherein the diameter lies in a plane substantially parallel to a tangential plane on an outer surface of the bone.

15. The hearing prosthesis according to claim 14, wherein: the implantable component is configured to be at least partially implanted in a cortical bone layer of a skull of a recipient such that the generated vibrations are transferred from the implantable component directly to the cortical bone layer via the alteration of the diameter.

16. The vibrator of claim 1, wherein the generally cylindrical and radially expandable bone contacting surface is configured to radially expand in a manner that induces longitudinal sound waves in the skull bone.

17. The vibrator of claim 1, wherein the generally cylindrical and radially expandable bone contacting surface is configured, when implanted, to radially expand in a manner that induces longitudinal sound waves transmitting in a direction substantially perpendicular to the bone contacting surface.

18. The vibrator of claim 1, wherein the generally cylindrical and radially expandable bone contacting surface is an outermost surface of the piezo-electric or magneto-elastic element.

19. The vibrator of claim 1, wherein the generally cylindrical and radially expandable bone contacting surface is an outer housing of the piezo-electric or magneto-elastic element.

20. The hearing prosthesis of claim 9, wherein the implantable component is configured to be implanted in the recipient at a location outside of an inner ear, middle ear, and auditory canal of the recipient.

21. A hearing prosthesis, corn rising:

an implantable component including: (1) at least one of a piezo-electric or magneto-elastic element; and (2) an outer housing including a generally cylindrical and radially expandable outer surface configured to contact bone and configured to radially expand in response to a sound signal to generate, when implanted, vibrations in the bone, wherein the implantable component is configured to be implanted in a recipient at a location outside a middle ear, inner ear, and auditory canal of the recipient, and wherein the hearing prosthesis is configured such that, when implanted, the generated vibrations pass through bone of the recipient on a route from the implantable component to the inner ear of the recipient; wherein the piezo-electric or magneto-elastic element is arranged to be at least partially implanted directly into the skull bone behind the outer ear so that the vibrations are transferred directly from the element to the bone and transferred in the skull bone to the inner ear.

* * * * *

UNITED STATES PATENT AND TRADEMARK OFFICE

CERTIFICATE OF CORRECTION

PATENT NO. : 8,620,015 B2
APPLICATION NO. : 12/601797
DATED : December 31, 2013
INVENTOR(S) : Marcus Andersson et al.

It is certified that error appears in the above-identified patent and that said Letters Patent is hereby corrected as shown below:

In the Claims

Column 8, line 5 (Claim 21, line 1) correct:

from "A hearing prosthesis, corn rising:"

to --A hearing prosthesis, comprising--.

Signed and Sealed this
Fifteenth Day of April, 2014

Michelle K. Lee

Michelle K. Lee
*Deputy Director of the United States Patent and Trademark Office*